US006048112A

United States Patent [19]

Jung et al.

[11] Patent Number: 6,048,112

[45] Date of Patent: Apr. 11, 2000

[54] APPARATUS AND METHOD FOR PROCESSING PHOTOGRAPHIC EMULSION CARRIERS

[75] Inventors: Christoph Jung, München; Rainer Schuster, Mammendorf, both of Germany

[73] Assignee: AGFA-Gevaert AG, Leverkusen, Germany

[21] Appl. No.: 09/123,753

[22] Filed: Jul. 27, 1998

[30] Foreign Application Priority Data

Aug. 22, 1997 [DE] Germany ..... 197 36 525

[51] Int. Cl.[7] ..... G03D 3/02

[52] U.S. Cl. ..... 396/626

[58] Field of Search ..... 396/626, 630; 134/64 P, 122 P; 430/398–400

[56] References Cited

U.S. PATENT DOCUMENTS

| | | | |
|---|---|---|---|
| 3,997,347 | 12/1976 | Parsonage | 430/398 |
| 4,160,594 | 7/1979 | Geyken et al. | 396/626 |
| 5,272,499 | 12/1993 | Yamada | 396/626 |
| 5,678,112 | 10/1997 | Bernard et al. | 396/626 |

FOREIGN PATENT DOCUMENTS

| | | | |
|---|---|---|---|
| 0 491 049 | 6/1992 | European Pat. Off. | G03D 3/00 |
| 39 21 657 | 12/1990 | Germany | G03D 5/00 |
| 41 05 918 | 8/1992 | Germany | G03C 5/29 |
| 41 14 591 | 11/1992 | Germany | G03C 5/395 |
| 43 03 379 | 8/1994 | Germany | G03D 3/06 |

OTHER PUBLICATIONS

Derwent Abstract for corresponding application No. DE 39 21 657.

*Primary Examiner*—D. Rutledge
*Attorney, Agent, or Firm*—Darby & Darby

[57] ABSTRACT

A processor for photographic emulsion carrier is disclosed in which the emulsion carriers are transported sequentially first though a plurality of processing stages and the through a washing unit. A rinse unit is placed between two processing stages. The rinse unit and the washing unit are connected with each other so that the rinse water from the rinse unit reaches the washing unit in a controllable way.

8 Claims, 1 Drawing Sheet

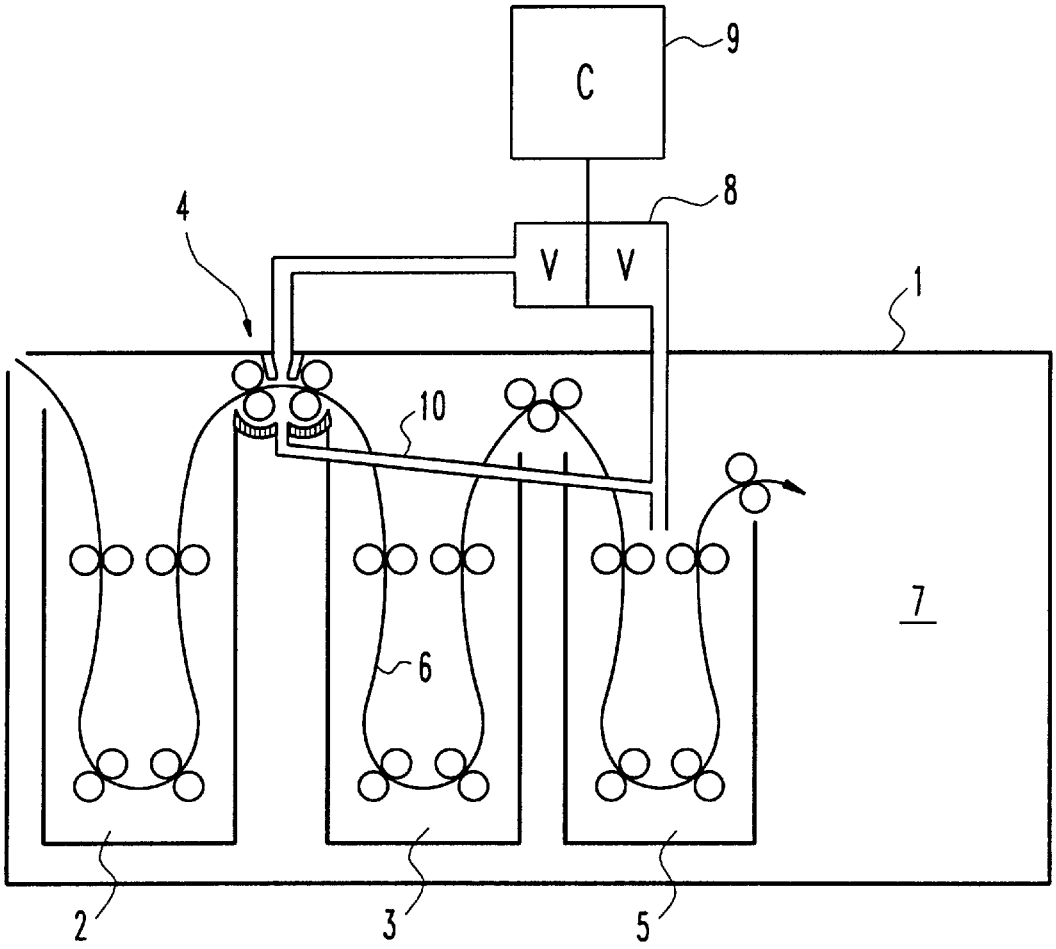
C
9
8
4
V
V
1
10
7
6
2
3
5

APPARATUS AND METHOD FOR PROCESSING PHOTOGRAPHIC EMULSION CARRIERS

BACKGROUND OF THE INVENTION

1. Field of the Invention

The present invention relates to an apparatus and a method for processing for a photographic emulsion carrier, such as photographic materials. The emulsion carrier is transported sequentially through several processing stages followed by a washing stage, utilizing a rinse unit placed between the stages.

2. Description of the Related Art

A wet processor of this type is described, for example, in DE 39 21 657 C1. This reference describes an intermediate washing unit which is arranged between various film processing tanks. A spray tube assembly is located between the processing tanks for spraying the film with water for removing the processing fluid from the film. However, when the film is rinsed, chemicals are washed and mixed into the rinse water and the disposal of such contaminated rinse water is expensive and often connected with difficulties. It is therefor proposed to treat the rinse water so that the contaminants are removed so that the water is prepared to be reusable, thereby reducing the water consumption.

DE 41 05 918 also proposes a wet processing system incorporating an intermediate washing, in which the spent rinsing water is reused, after being purified, mixed with chemicals and subsequently filled as processing fluid into the processing tanks. However, a significant amount of energy is required to purify the rinse water.

A simpler approach for reusing spent rinsing water is described in DE 41 14 591. There, the water which is drained from the outlet side of a wash unit that follows a processing step, is supplied to the inlet side of a preceding intermediate washing tank.

SUMMARY OF THE INVENTION

It is the object of the invention to provide a processing apparatus which enables improved processing of a photographic emulsion carrier.

Another object of the invention is to provide a processing apparatus in which a emulsion carrier is transported sequentially through several processing stages followed by a washing stage, utilizing an improved rinsing.

Yet another object of the invention is to provide a processing apparatus which operates such that the water consumption for the rising process is reduced.

Further, another object of the invention is to provide a processing apparatus which operates effectively with reduced water consumption for the rinsing process, without adversely affecting the quality of the photographic emulsion carrier.

The preceding objects, as well as others which will become apparent as the description proceeds, are achieved by the invention.

One aspect of the invention resided in an arrangement of a processor apparatus in which the rinse unit and the wash unit are connected with each other so that the rinse water from the rinse unit reaches the wash unit. The emulsion carrier is transported sequentially through several processing stages followed by a washing stage. The rinse unit is arranged between two processing stages and the rinse unit and the wash unit are connected with each other such that the water used for the rinse unit reaches the wash unit.

Another aspect of the invention resides in an arrangement for a processor in which the contaminated rinse water that drains from the rinse unit is being reused in the wash unit, thereby reducing the quantity of fresh water that is supplied to the wash unit. After the photographic emulsion carrier passes through the processing stages, the photographic emulsion carrier is treated again with water which is contaminated with chemicals from the processing stage. However, because additional fresh water is supplied to the wash unit, the contamination by these chemical substances is reduced or diluted to such a low level that the contamination has no adverse affect on the quality of the development. It is essential for the quality of the development that at the end of the entire processing regime, the emulsion carrier is washed with a required minimum amount of water. In addition, the emulsion carrier has to be rinsed after the developing bath in order to prevent the developer solution from being carried over to the fixing bath. According to the invention, the rinsing step does not require any additional quantity of water because the entire quantity of rinse water is routed to the final wash unit.

The total quantity of the water necessary for satisfactory results depends on the surface area of the emulsion carrier that is being developed and a determined amount is allocated accordingly to the rinse unit and to the wash unit. If a large portion of a required quantity of water is already supplied to the rinse unit, then the quantity of fresh water supplied to the wash unit can be reduced and is relatively small. The fresh water is metered by controllable solenoid valves so that the fresh water is allocated as necessary. Accordingly, the operator can control the valves such that only fresh water is supplied through the rinse unit. Thus, the solenoid valve controlling the fresh water supply of the wash unit can also be eliminated, allowing all of fresh water to be supplied through the rinse unit. However, if a valve is desired, it may be disposed such that both the rinse unit and the wash unit are connected to a fresh water supply via the metering device.

A particularly preferred arrangement is to connect to the wash unit a rinse unit which is located between the developing and the fixing bath. In this arrangement, the water mixed with the developer solution is introduced into the wash unit in which the final wash of the emulsion carrier takes place, after the emulsion carrier has passed through the fixing bath. Unexpectedly, the added chemicals from the developer did prevent water spots to from when the emulsion carrier was dried.

The rinse water can be supplied to the wash unit simply by connecting the overflow of the rinse unit with the inlet of the wash unit such that the rinse water flows by gravity to the wash unit, without requiring a pump. In such arrangement, the inlet of the wash unit is placed below the overflow of the rinse unit. If it is not desirable or practical to design the apparatus with an inlet of the wash unit being placed below the overflow of the rinse unit, the rinse water can also be transported to the wash unit with a pump. As can easily be appreciated, adding a pump is more expensive by incurring initial costs and maintenance costs.

In processor apparatuses which include several rinse units located between various processing stages, the invention provides that several rinse units can with connected with each other and subsequently to the wash unit. The rinse water from one particular rinse unit can then either be mixed into the rinse water supplied to the next rinse unit so as to reach the wash unit after having passed through several rinse units, or it can be routed directly to the wash unit.

Additional features and advantages of the invention include an overflow in the rinse unit which is connected to an inlet of the wash unit.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWING

In the drawing, the preferred apparatus for processing photographic emulsion carrier apparatus is schematically shown:

FIG. 1 Show a schematical view of the processor.

DETAILED DESCRIPTION OF THE PRESENTLY PREFERRED EMBODIMENTS

The processor illustrated in FIG. 1 includes a developing bath 2 and a fixing bath 3, with a rinse unit 4 located between the developing bath and the fixing bath. Located subsequent to the fixing bath is a wash unit 5 through which the photographic emulsion carrier 6 is transported after having passed through the developing bath 2 and the fixing bath 3. The photographic emulsion carrier is subsequently conveyed to a drier 7. During development, the photographic emulsion carrier is washed both in the rinse unit 4 and in the wash unit 5. The required fresh water is supplied through a dual solenoid valve 8 which is controlled by a controller 9. According to the invention, between the outlet of the rinse unit 4 and the inlet of the wash unit 5 there is provided a water conduit 10 which carries the rinse water containing the mixed-in developer chemicals to the fresh water supply of the wash unit. The quantity of fresh water required to effectively wash the emulsion carrier in the wash unit 5 can thereby be reduced, without impairing the quality of the developed emulsion carrier. On the contrary, an advantageous effect has been observed: the formation of water spots during the drying process can be reduced substantially.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawing is not necessarily drawn to scale but that they are merely conceptual in nature. It is the intention, therefore, to be limited only as indicated by the scope of the claims appended hereto.

What is claimed is:

1. An apparatus for processing a photographic emulsion carrier, comprising at least one developing bath, at least one fixing bath, at least one washing unit, a rinse unit and a water conduit; said rinse unit being disposed between said at least one developing bath and said at least one fixing bath; and wherein said rinse unit and said the washing unit are connected by said water conduit such as to provide rinse water from the rinse unit to the washing unit; and further comprising a valve and fresh water supply; said valve being disposed in the water conduit between said rinse unit, said washing unit and said fresh water supply.

2. The apparatus for processing a photographic emulsion carrier according to claim 1, wherein the valve is controllable by a metering device.

3. The apparatus for processing a photographic emulsion carrier according to claim 2, wherein the valve is a dual solenoid valve.

4. The apparatus for processing a photographic emulsion carrier according to claim 3, wherein s aid metering device is utilized to minimize the supply of fresh water.

5. The apparatus for processing a photographic emulsion carrier according to claim 4, wherein said rinse unit comprises an overflow which is connected to the wash unit.

6. An apparatus for processing a photographic emulsion carrier, comprising at least one developing bath, at least one fixing bath, at least one washing unit, a rinse unit and a first conduit; said rinse unit comprising an inlet and an outlet; said rinse unit being disposed between said at least one developing bath and said at least one fixing bath; and wherein said outlet of said rinse unit is connected to said washing unit by said conduit such as to provide rinse water from the rinse unit to the washing unit; and further comprising a second conduit and a metering system, said second conduit being connected to said inlet of said rinse unit and is further connected to said at least one washing unit.

7. The apparatus for processing a photographic emulsion carrier according to claim 6, further comprising fresh water supply to said metering unit.

8. The apparatus for processing a photographic emulsion carrier according to claim 7, wherein said metering comprises a controllable dual solenoid valve.

* * * * *